United States Patent [19]

Tombal et al.

[11] Patent Number: 4,489,835

[45] Date of Patent: Dec. 25, 1984

[54] DEVICE FOR HANDLING ARTICLES IN THE FORM OF SHEETS

[75] Inventors: Gérard Tombal, Paris; Gilbert Pagnucco, Maurepas, both of France

[73] Assignee: Boussois S.A., Levallois-Perret, France

[21] Appl. No.: 377,260

[22] Filed: May 11, 1982

[30] Foreign Application Priority Data

May 29, 1981 [FR] France ..... 81 10684

[51] Int. Cl.³ ..... A47F 7/00

[52] U.S. Cl. ..... 211/41; 206/448; 206/454; 206/505

[58] Field of Search ..... 211/41; 108/533, 53.5, 108/91; 297/239; 206/451, 448, 454, 504

[56] References Cited

U.S. PATENT DOCUMENTS

| | | | |
|---|---|---|---|
| 2,833,607 | 5/1958 | Mackintosh | 108/91 X |
| 3,147,860 | 9/1964 | Kean, Sr. . | |
| 3,887,071 | 6/1975 | Thomaswick | 206/454 |
| 3,938,660 | 2/1976 | Moehring . | |
| 4,067,606 | 1/1978 | Desmoulins et al. | 108/91 X |
| 4,191,112 | 3/1980 | Maldonado . | |
| 4,266,678 | 5/1981 | Daly | 108/533 X |

FOREIGN PATENT DOCUMENTS 2210988 12/1974 France .

*Primary Examiner*—Robert W. Gibson, Jr.

*Attorney, Agent, or Firm*—Young & Thompson

[57] ABSTRACT

The device for handling articles in the form of sheets such as windshields comprises a floor of trapezoidal shape for receiving a stack of sheets, a bearing member and two side-panels which are outwardly divergent from a rear framework. Empty containers can therefore form a nested assembly for return transportation. In order to facilitate nesting, the metallic lining plates of the side-panels are upwardly divergent. A recess is formed in the floor in order to house the bearing member of the empty container to be nested therein.

8 Claims, 10 Drawing Figures

FIG_1
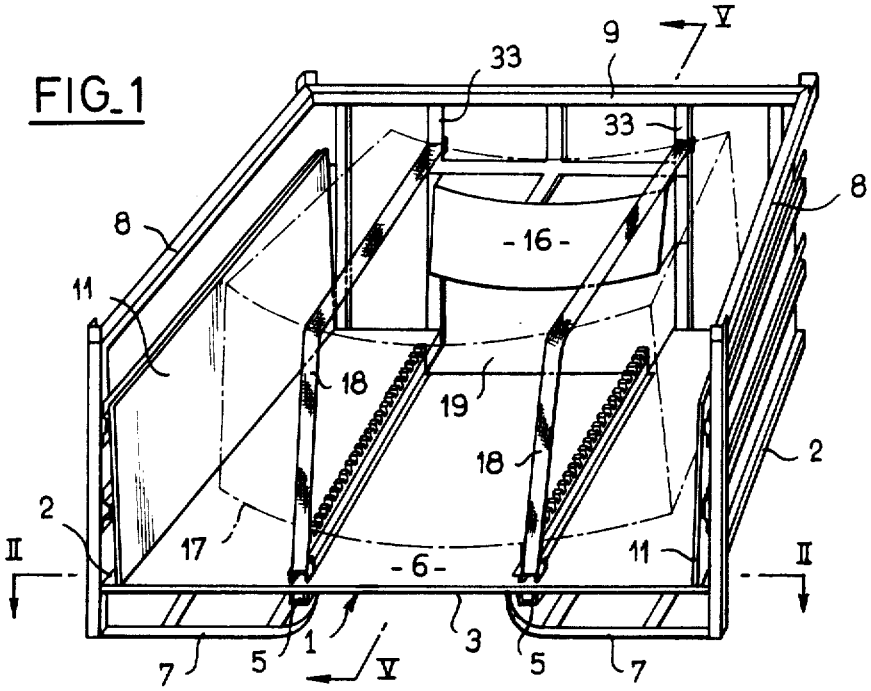
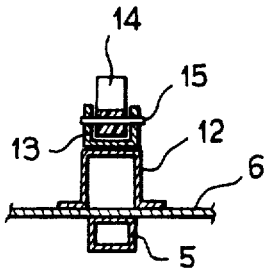
FIG_3
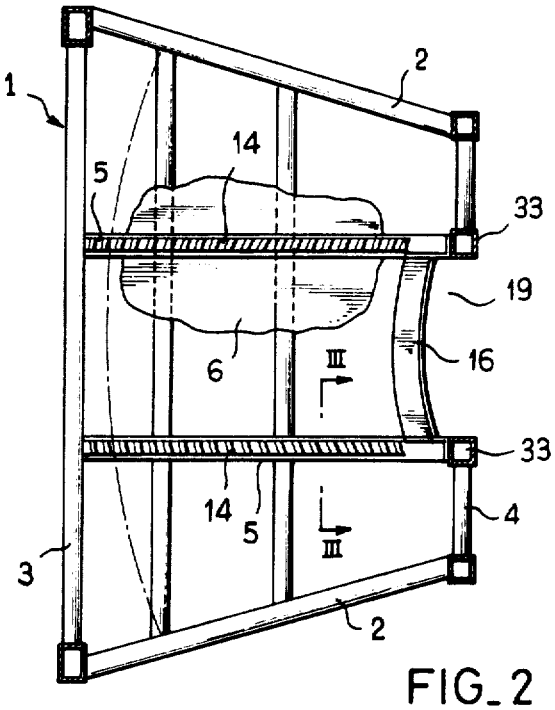
FIG_2

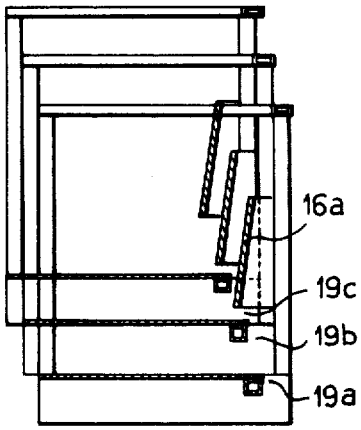
FIG_4
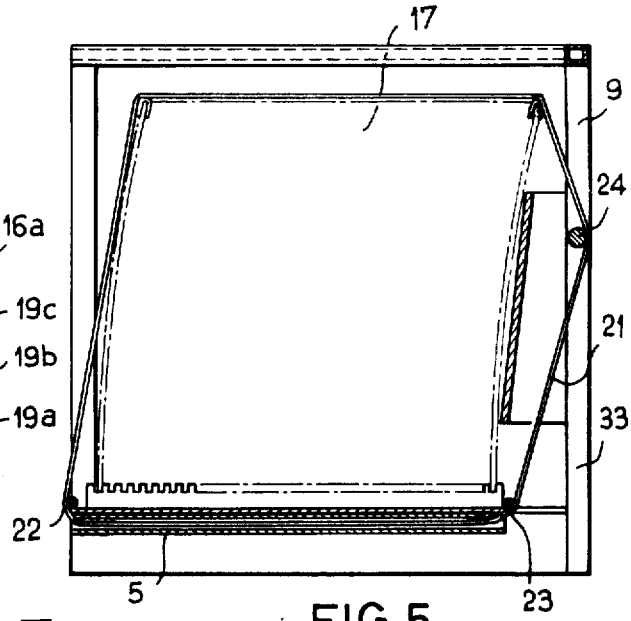
FIG_5
FIG_6
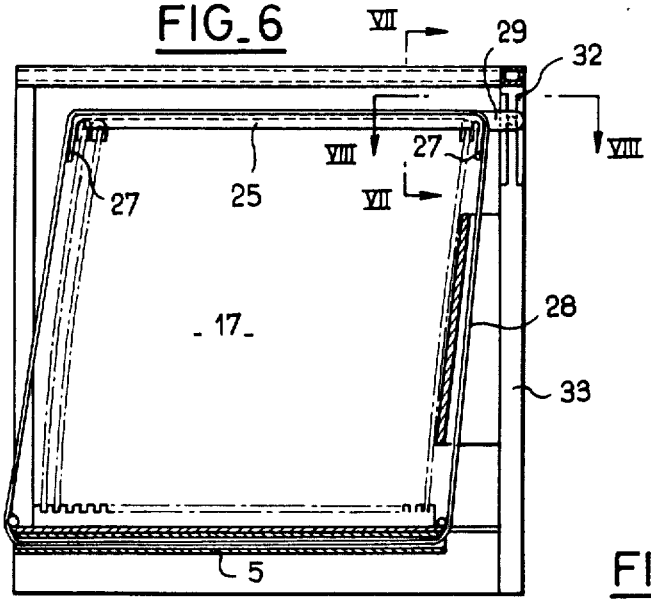
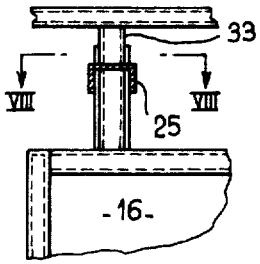
FIG_7
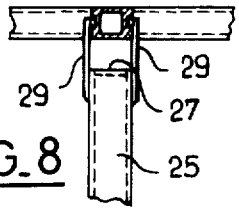
FIG_8
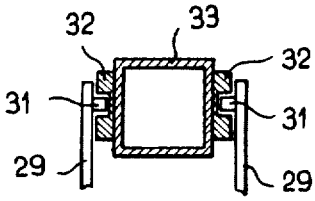
FIG_9
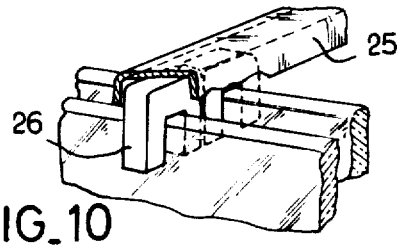
FIG_10

DEVICE FOR HANDLING ARTICLES IN THE FORM OF SHEETS

This invention relates to a device for handling articles especially in the form of sheets such as windshields.

The handling of objects of this type in wooden crates suffers from numerous disadvantages. In addition to the large number of handling operations at the time of loading and unloading which entail the need for a large labor force and result in considerable loss of time, the return of empty crates and wrappings sets a problem of excessive bulk. Furthermore, crates have a relatively short service life and are costly to maintain.

Metallic handling devices have also been constructed. A device of this type consists of a floor fitted with three vertical side-racks or panels in order to ensure that the sheets which rest on their edges and form a stack are protected against shock impacts. Maximum ease of access to the sheets facilitates loading and unloading operations and the service life of the device is increased.

However, the bulk of the handling unit remains the same when it is returned empty. It has accordingly been proposed to provide side-racks or panels which can either be folded or detached. The disadvantage of this solution, however, lies in the potential danger either of loss of parts or of mechanical damage.

The object of the present invention is to provide a handling device designated hereinafter as a container which offers all the advantages of metallic containers together with the additional advantage of small bulk when empty without any need for disassembly.

According to the invention, the device for handling articles especially in the form of sheets such as windshields comprises a floor, a bearing member for supporting said articles and two side-panels which are substantially vertical in service, said side-panels being in oppositely-facing relation and fixed on two opposite edges of the floor. The device is distinguished by the fact that the floor is of trapezoidal shape such that the floor edges adjacent to the side-panels form the sides of the trapezium.

This distinctive feature permits immediate storage by nesting of one container within another. Interengagement of the containers by nesting takes place floor against floor and side-panel against side-panel, with the result that the assembly consisting of two nested containers occupies a volume which is considerably smaller than the sum of the bulk or occupied volumes of the individual containers.

The same storage assembly can be constituted by a plurality of nested containers as long as a prohibitive bulk is not attained.

In a preferred embodiment of the invention, the bearing member is a surface secured to a rear framework which is in turn secured to the small base of the floor and to the side-panels.

The presence of the rear panel does not interfere with the nesting operation which is performed by presenting the small base of the receiving container in front of the large base of the engaging container.

In an advantageous embodiment of the invention the floor is provided opposite to the bearing member with a recess which extends over a length at least equal to the width of said bearing member.

By virtue of this recess, the bearing member of one engaging container is not liable to strike the floor of a receiving container.

In an improved embodiment of the invention, the floor comprises two longitudinal members extending from the small base to the large base of the trapezium and having a relative spacing which is smaller than the width of the stack of sheets to be placed on the floor. Each longitudinal member is secured to a toothed rack in which the rack notches are at least equal in width to the thickness of the sheets in order to set the sheets securely in a fixed position on the floor.

Provision is also made for at least one strap attached at one end to the floor and at the other end to the rear framework in order to secure the stack of sheets in rigidly fixed relation to the container.

These and other features of the invention will be more apparent upon consideration of the following description and accompanying drawings, wherein:

FIG. 1 is a general view in perspective showing a device according to the invention;

FIG. 2 is a sectional plan view taken along line II—II of FIG. 1;

FIG. 3 is a sectional view taken along line III—III of FIG. 2;

FIG. 4 is a sectional view of three empty containers forming a nested assembly;

FIG. 5 is a sectional view taken along line V—V of FIG. 1 but in another embodiment of the system for attaching sheets to the container;

FIG. 6 is a view which is similar to FIG. 4 but in another alternative embodiment;

FIG. 7 is a sectional view taken along line VII—VII of FIG. 6;

FIG. 8 is a sectional view taken along line VIII—VIII of FIGS. 6 and 7;

FIG. 9 is an enlarged view of a portion of FIG. 8;

FIG. 10 is an enlarged view in perspective showing a portion of FIG. 6.

Referring to FIGS. 1 and 2, the container according to the invention comprises a floor 1 delimited by two lateral edges 2, a rear edge 4 and a front edge 3. The floor framework is constituted by square-section tubing in the same manner as the entire container and is completed by two longitudinal members 5 extending from the front edge to the rear edge and covered by a sheet-metal plate 6. The distance between said longitudinal members is shorter than the width of the stack of sheets 17 to be loaded in the container.

The underside of the floor 1 is provided with an auxiliary framework 7 for transferring the container by means of a fork-lift truck.

Two side-panels 8 extend vertically (in the service position) from the lateral edges 2, and a rear framework 9 forming an end-panel is secured to the aforementioned side-panels and to the rear edge 4.

The floor 1 is trapezoidal, so that the front edge 3 accordingly constitutes the large base of the trapezium and the rear edge 4 constitutes its small base. Correlatively, the side-panels 8 progressively widen-out from the rear end to the front end. The container as a whole is thus inscribed within an approximately frusto-pyramidal volume, the lateral faces of which are constituted by the floor and side-racks; the small base of the pyramid frustum is constituted by the rear end-panel 9 and the large base of the pyramid frustum is constituted by the vertical plane located between the front edge 3 and the side-panels 8.

Strictly speaking, the above-mentioned volume is not a true pyramid frustum since the side-panels are rectangular but the expression will nevertheless be retained for the sake of simplicity since it is given a specific definition in this particular application.

The side-panels 8 are also provided with sheet-metal plates 11 so arranged as to be upwardly divergent and thus to give the container a flared-out shape in the upward direction.

On the floor 1 and opposite to the longitudinal members 5 are fixed supports 12 for the U-section members 13 in which are inserted toothed racks 14 of plastic material, said racks being held in position by means of locking-pins 15 (as shown in FIG. 3). The notches of said toothed racks have a width at least equal to the thickness of the sheets to be transported in order to permit fitting of said sheets in position. The notches are slightly oblique with respect to the front and rear edges of the floor in order to permit fitting of curved windshields.

A sheet-metal member 16 which is curved to correspond in shape to the windshields to be transported is secured to the rear framework 9 in order to serve as a bearing member for the end sheet of the stack 17 which is packed in the container.

Straps 18 are attached to the rear framework and to the front edge 3 of the floor in order to secure the stack of sheets to the container.

The floor is provided opposite to the bearing surface 16 with a recess 19 which extends over the entire width of said surface 16.

Storage of empty containers for the return trip is carried out by interengagement or nesting as shown in FIG. 4. Nesting storage is made possible by the obliquity of the side-panels 8 and the operation is facilitated by the obliquity of the sheet-metal plates 11 with which said side-panels are provided.

Nesting in precise interfitting relation is made possible by the recesses 19. It is in fact apparent from FIG. 4 that the bearing surface 16*a* of the first engaging container comes into position within the recess 19*c* of the third container.

In a first alternative embodiment shown in FIG. 5, the stack of sheets 17 is secured by means of disposable ropes or cables 21 passed within the longitudinal members 5. Round-section rods 22, 23 are attached in the vicinity of the front and rear edges of the floor in order to serve as a plastic-foam support for said ropes. A third rod 24 is attached to the rear framework 9 in such a manner as to ensure that the direction of the clamping force is not liable to induce breakage of the sheets.

In another alternative embodiment shown in FIGS. 7 to 10, provision is made for a U-section bar 25 which is intended to be fitted over intercalary riders 26 placed on the top edges of the sheets (as shown in FIG. 10). The ends 27 of said bars are turned-down in order to enclose the stack of sheets and the tightening ropes 28 are placed over the bars 25 so that the clamping force is applied to said bars and is not liable to compress the stack 17 to such an extent as to entail the risk of breakage of the sheets.

The bars 25 are adapted to carry two extensions 29 each provided with a stud 31 (as shown in FIGS. 8 and 9) and slidably engaged in guides 32 provided on an upright member 33 of the rear framework 9. Thus the bars 25 are rigidly fixed to the container while being adjustable according to the height of the sheets to be transported.

The container described in the foregoing does not comprise any detachable or folding component and is therefore of highly rugged construction. A nested assembly of empty containers, however, is of very small overall size and thus permits a return trip at very low cost.

Furthermore, the device offers excellent accessibility to transported articles and permits automated loading and unloading operations.

As can readily be understood, the invention is not limited to the examples described in the foregoing but extends to any technological variant within the capacity of those versed in the art.

What is claimed is:

1. A device for handling articles especially in the form of sheets such as windshields, comprising a floor of trapezoidal shape, two side-panels which are substantially vertical in service, said side-panels being in oppositely facing relation and fixed on two opposite edges of the floor so that the floor edges adjacent to the side-panels form the sides of a trapezium, and a bearing member in the form of a surface secured to a rear framework which is in turn secured to the small base of the floor and to the side panels, the floor being provided beneath the bearing member with a recess which extends over a length at least equal to the length of said bearing member.

2. A device according to claim 1, wherein the floor comprises two longitudinal members extending from the small base to the large base of the trapezium and having a relative spacing which is smaller than the width of a stack of sheets to be placed on said floor.

3. A device according to claim 1, wherein a toothed rack is secured to each longitudinal member and the rack has notches that are at least equal in width to the thickness of the sheets of the stack to receive said sheets therein.

4. A device according to claim 3, wherein said device comprises at least one strap attached at one end to the floor and at the other end to the rear framework.

5. A device according to claim 3, wherein said device comprises round-section rods fixed in the vicinity of the bases of the floor in a direction parallel to said bases in order to serve as supports for tieing means used for securing the stack of sheets.

6. A device according to claim 3, wherein said device comprises at least one sectional bar so arranged as to bear on riders mounted on the top edge of each sheet, the ends of said bar being turned-down in order to enclose the stack and said bar being provided with assembly elements slidably mounted on a vertical longitudinal member of the rear framework.

7. A device according to claim 1, wherein the side-panels have an open-work structure.

8. A device according to claim 1, wherein the side-panels are fitted with upwardly divergent lining plates.

* * * * *